US007309215B2

(12) United States Patent
Negulescu

(10) Patent No.: US 7,309,215 B2
(45) Date of Patent: Dec. 18, 2007

(54) AXIAL LOCKING DEVICE FOR TURBINE BLADES

(75) Inventor: Joana Negulescu, Berlin (DE)

(73) Assignee: Rolls-Royce Deutschland Ltd & Co KG, Blankenfelde-Mahlow (DE)

( * ) Notice: Subject to any disclaimer, the term of this patent is extended or adjusted under 35 U.S.C. 154(b) by 0 days.

(21) Appl. No.: 11/443,475

(22) Filed: May 31, 2006

(65) Prior Publication Data

US 2006/0280611 A1 Dec. 14, 2006

(51) Int. Cl.
*F01D 5/32* (2006.01)

(52) U.S. Cl. ..... 416/220 R; 416/204 A; 416/248

(58) Field of Classification Search ..... 416/220 R, 416/221, 219 R, 204 A, 248
See application file for complete search history.

(56) References Cited

U.S. PATENT DOCUMENTS 2,846,183 A 8/1958 Morgan
3,759,633 A * 9/1973 Tournere ..... 416/220 R
3,853,425 A * 12/1974 Scalzo et al. ..... 416/220 R

FOREIGN PATENT DOCUMENTS

| | | |
|---|---|---|
| DE | 22 00 515 C3 | 7/1972 |
| DE | 44 41 233 A1 | 5/1996 |
| FR | 9 76 790 B | 3/1951 |

* cited by examiner

*Primary Examiner*—Richard A. Edgar
(74) *Attorney, Agent, or Firm*—Timothy J. Klima

(57) ABSTRACT

A turbine blade locking device for axial retention of a turbine blade (1) having a blade root (3) inserted in an axially extending profiled lobe slot (5) of a turbine disk (4), wherein, a sealing fin of a blade platform (10) includes, over part of its axial length, a retaining groove (6) featuring a semicircular cross-section, a disk lobe (7) of the turbine disk (4) is provided with a semi-spherical recess (8), and a ball (2) is fitted into the recess (8) and the retaining groove (6).

16 Claims, 2 Drawing Sheets

AXIAL LOCKING DEVICE FOR TURBINE BLADES

This application claims priority to German Patent Application DE 10 2005 024 932.9 filed May 31, 2005, the entirety of which is incorporated by reference herein.

BACKGROUND OF THE INVENTION

This invention relates to a turbine blade locking device for axial retention of a turbine blade on the turbine disk.

In the state of the art it is known to provide the blade roots of turbine blades with a profile to take up the radially directed forces occurring during the operation of a gas turbine. In order to prevent the blade root from moving axially relative to the turbine disk, a means of retention is required. Such means of retention are shown in Specifications EP 0 610 668 B1, U.S. Pat. No. 5,135,354 or U.S. Pat. No. 5,518,369 by way of example.

In the designs known from the state of the art, plate-type elements (locking plates, cover plates and locking rings) are usually fitted which, together with abutments on the blade roots or the turbine disks, provide for axial retention. Disadvantages here are the high assembly effort and the risk that these fixations may work loose or be inaccurately fitted, resulting in at least a slight axial displacement of the blade root relative to the turbine disk.

More particularly, cover plates, locking rings or locking plates, or a combination thereof, are used in the state of the art, which must be deformed, for example, bent, during assembly. A further disadvantage is the higher mass of the total design and the considerable manufacturing and assembly costs. Another disadvantage lies in the fact that serviceability and reliability are not always ensured or that relatively expensive inspection activities are required to check for correctness of assembly.

BRIEF SUMMARY OF THE INVENTION

A broad aspect of the present invention is to provide a turbine blade locking device of the type specified above which, while being characterized by simple design, easy and cost-effective manufacture and easy assembly, provides for a high degree of reliability and safety.

It is a particular object of the present invention to provide a solution to the above problems by a combination of the features described herein. Further advantageous embodiments of the present invention will be apparent from the description below.

The present invention accordingly provides a ball for retention, this ball acting as a stop. The functional principle is that one half of the ball is located in a semi-spherical recess, while the other half of the ball is insertable into an axial groove during assembly. Accordingly, one half of the ball is arranged in the blade root and the other in the turbine disk, providing axial retention in the form of an axial stop.

It is, therefore, not required to secure the turbine blades on the disk rim or the turbine disk by means of locking plates or cover plates or locking rings. Rather, it is sufficient to insert a ball which is inexpensively procurable and, moreover, is characterized by low weight and does not require further assembly aids or auxiliary components.

The present invention, other than the state of the art, does not result in increased surge losses or leakages in the blade neck area since the mating faces between the blade root and the turbine disk are not affected functionally by additional assembly means, such as milled hooks or detents, as provided in the state of the art. The present invention provides for two variants. In one variant, a sealing fin of a blade platform, over part of its axial length, is provided with a retaining groove which accommodates one half of the ball and is, therefore, given a semicircular cross-section, while the other half of the ball is arranged in a semi-spherical recess of the turbine disk or the disk lobe. In another variant, the groove is provided in the turbine disk or in the turbine disk lobe slot, respectively, while the semi-spherical recess is provided in the blade root. Which of the two variants is selected depends on the respective design situation, with potential for optimization being available in either case.

Accordingly, a light and cost-effective design is provided which is characterized by simple assembly and easy and unproblematic disassembly. Favorable force conditions result in lower mechanical loading, leading to an increase in the overall life of the turbine.

It is particularly favorable to provide the retaining groove with a partly spherical axial end area, enabling the associated surface of the ball to be precisely positioned and held for the transfer of forces. Obviously, the center axis of the recess accommodating one ball half preferably agrees, or coincides, with the radial center axis of the semi-spherical end area of the groove, providing for a precision of fit between the turbine blade and the turbine disk.

In accordance with the present invention, it may be favorable to fit an additional retaining element between the blade root and the turbine disk to provide for further axial retention. This retaining element can, for example, have the form of a positively acting ring.

BRIEF DESCRIPTION OF THE DRAWINGS

Embodiments of the present invention are more fully described in light of the accompanying drawings. In the drawings.

DETAILED DESCRIPTION OF THE INVENTION

Figure 1:
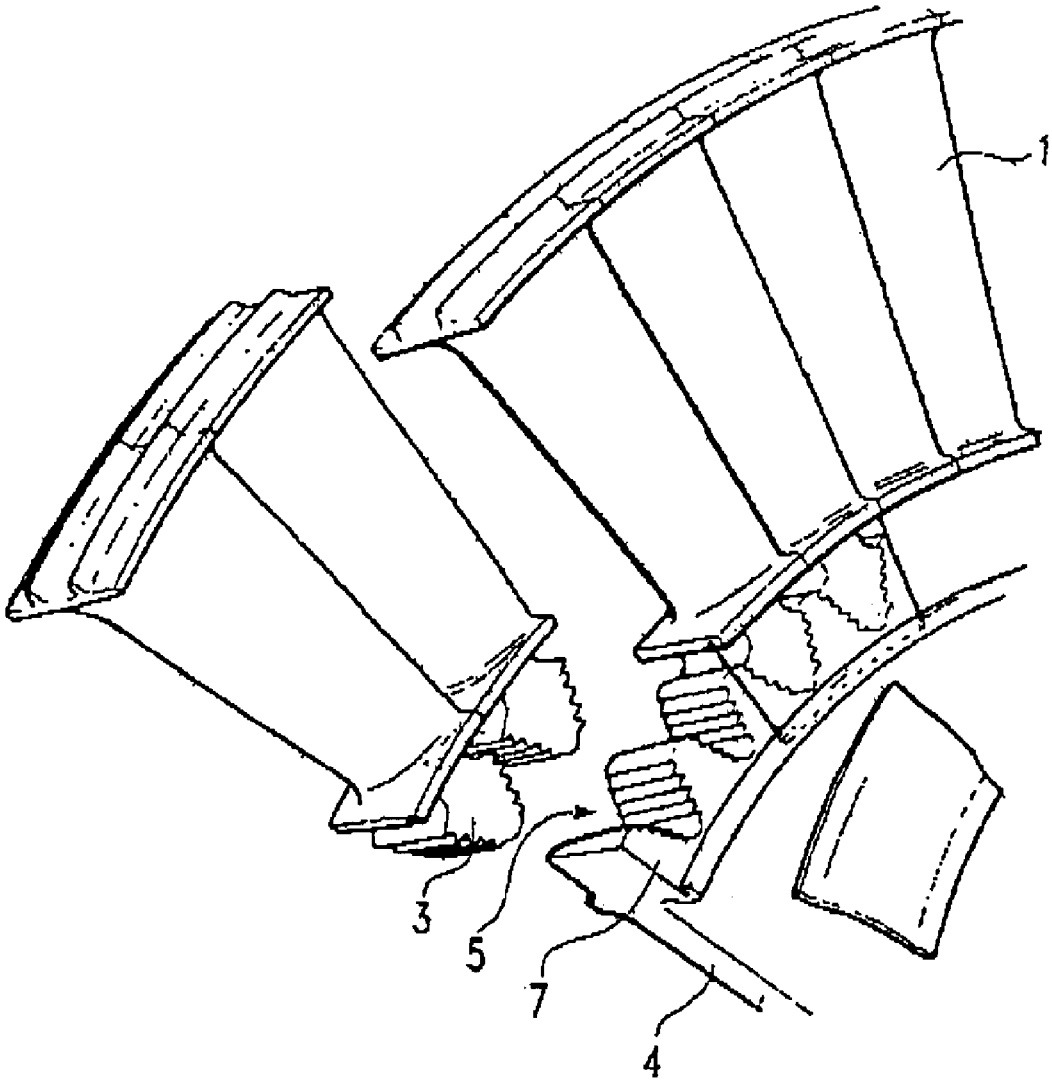
FIG. 1 Prior Art
FIG. 1 is a schematic representation of the state of the art in a perspective view.

FIG. 1 shows in schematic representation part of a turbine disk 4 with several disk lobes 7 forming axial lobe slots 5 into which blade roots 3 of turbine blades 1 are axially insertable. The contour of the lobe slot 5 and the blade roots 3 is selected such that a precision of fit is guaranteed. FIG. 1 shows that locking plates, or similar, are used for axial retention in the state of the art.

Figure 2:
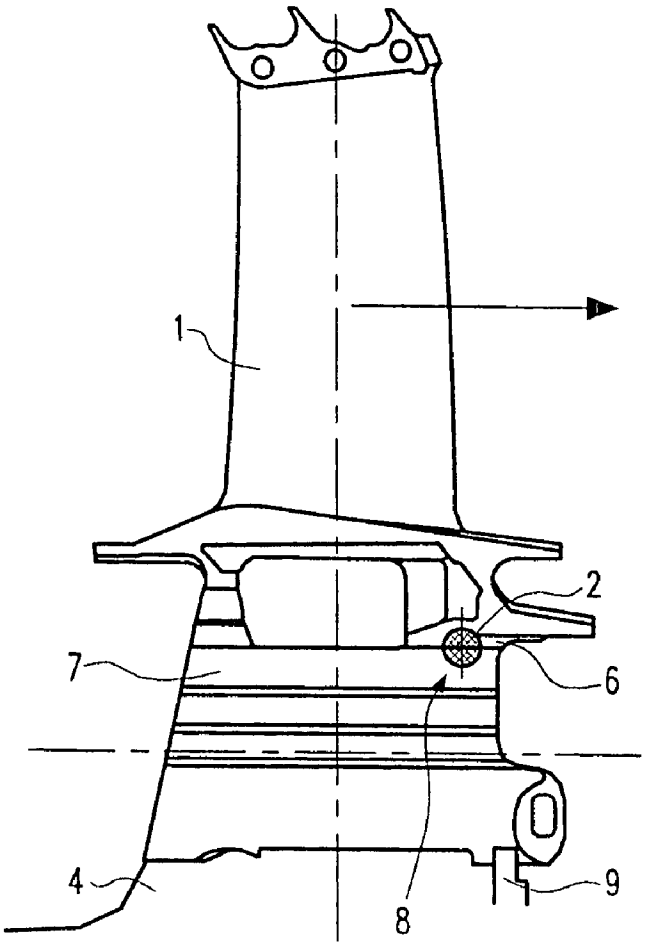
FIG. 2 is a partial side view of a first embodiment of the invention.

FIG. 2 shows, in a side view, a turbine blade 1 and a partial area of the turbine disk 4. FIG. 2 is a side view in which a ball 2 is arranged half in a semi-spherical seat (recess 8) machined in the disk lobe 7. A retaining groove 6 with semi-spherical cross-section is machined into the rearward sealing fin of the blade platform enabling the blade 1 to be installed from forward into the disk rim (turbine disk 4). Accordingly, the ball 2 is fitted first, then the turbine blade 1 inserted in the direction of the arrowhead. For additional retention, a retaining element 9, which can be installed in a suitable fitting groove, is provided, as known from the state of the art.

Figure 3:
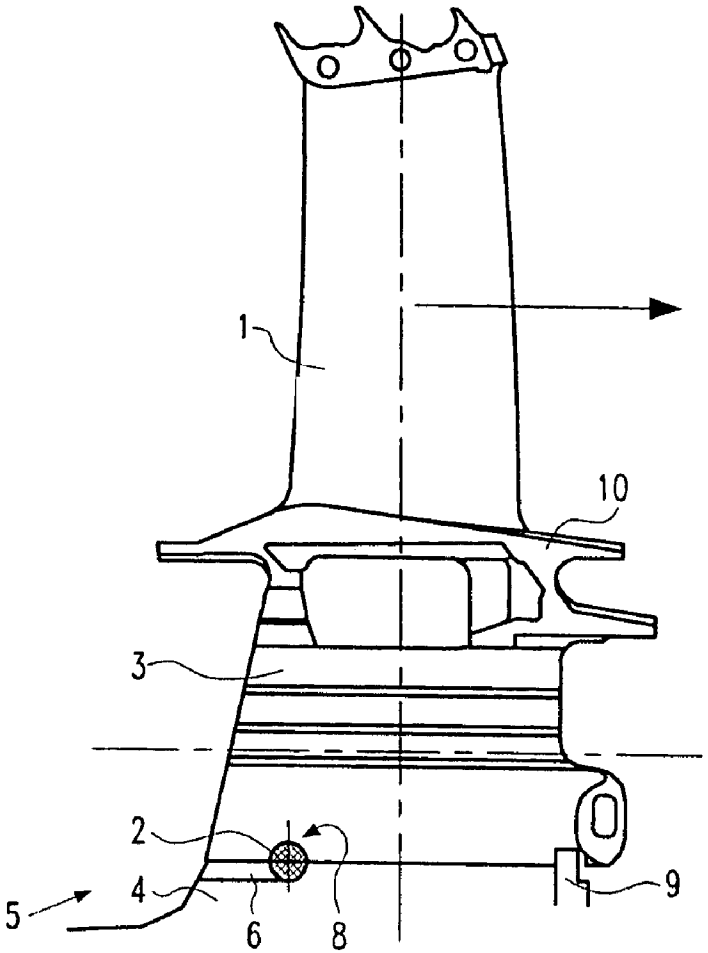
FIG. 3 is a partial side view, analogously to FIG. 2, of another embodiment of the present invention.

FIG. 3 shows an alternative design variant in which the ball seat (recess 8) is provided (machined) in the blade root.

The retaining groove 6 is here provided at the bottom of the disk lobe slot 5 of the turbine disk 4. During assembly, the ball 2 together with the blade 1 is in this variant moved forward in the disk rim (turbine disk 4) (see direction of arrow in FIG. 3). The ball 2 engages in the retaining groove 6 machined at the bottom of the disk lobe slot 5.

In both cases, the turbine blade 1 is secured rearward by simple and cost-effective means with low weight. For forward retention, a retaining element 9 is also used in the embodiment shown in FIG. 3.

LIST OF REFERENCE NUMERALS

1 Turbine blade
2 Ball
3 Blade root
4 Turbine disk
5 Disk lobe slot
6 Retaining groove
7 Disk lobe
8 Recess
9 Retaining element
10 Sealing fin of the blade platform

What is claimed is:

1. A turbine blade locking device, comprising:

a turbine disk having an axially extending profiled lobe slot and a disk lobe, the disk lobe of the turbine disk including a semispherical recess, a turbine blade having a blade root for insertion into the axially extending profiled lobe slot, the turbine blade having a blade platform having a sealing fin, the sealing fin including, over part of its axial length, an axially extending retaining groove having a semicircular cross-section, an open end and a closed end area, the semi-spherical recess and retaining groove facing one another when the blade root is positioned in the lobe slot, and a ball for simultaneously engaging both the recess and the axially extending retaining groove and allowing axial movement of the blade root into the lobe slot during such simultaneous engagement until the ball engages the closed end of the axially extending retaining groove to thereby prevent further axial movement of the blade in a direction of the open end of the axially extending retaining groove.

2. A turbine blade locking device, comprising:

a turbine disk having an axially extending profiled lobe slot, the lobe slot including, over part of its axial length, an axially extending retaining groove having a semi-circular cross-section, an open end and a closed end area;

a turbine blade having a blade root for insertion into the axially extending profiled lobe slot, the blade root including a semi-spherical recess, the retaining groove and semi-spherical recess facing one another when the blade root is positioned in the lobe slot, and a ball for simultaneously engaging both the recess and the axially extending retaining groove and allowing axial movement of the blade root into the lobe slot during such simultaneous engagement until the ball engages the closed end of the axially extending retaining groove to thereby prevent further axial movement of the blade in a direction of the closed end of the axially extending retaining groove.

3. A turbine blade locking device in accordance with claim 1, wherein the retaining groove includes a partly spherical axial end area whose radial center axis is identical with a radial center axis of the recess in an assembled state of the turbine disk.

4. A turbine blade locking device in accordance with claim 1, wherein the retaining groove axially leads to an outer area of the blade root.

5. A turbine blade locking device in accordance with claim 1, wherein a retaining element is fitted between the blade root and the turbine disk to provide for further axial retention.

6. A turbine blade locking device in accordance with claim 5, wherein the retaining element is in the form of a positively acting ring.

7. A turbine blade locking device in accordance with claim 3, wherein the retaining groove axially leads to an outer area of the blade root.

8. A turbine blade locking device in accordance with claim 7, wherein a retaining element is fitted between the blade root and the turbine disk to provide for further axial retention.

9. A turbine blade locking device in accordance with claim 8, wherein the retaining element is in die form of a positively acting ring.

10. A turbine blade locking device in accordance with claim 2, wherein the retaining groove includes a partly spherical axial end area whose radial center axis is identical with a radial center axis of the recess in an assembled state of the turbine disk.

11. A turbine blade locking device in accordance with claim 2, wherein the retaining groove axially leads to an outer area of the lobe slot.

12. A turbine blade locking device in accordance with claim 2, wherein a retaining element is fitted between the blade root and the turbine disk to provide for farther axial retention.

13. A turbine blade locking device in accordance with claim 12, wherein the retaining element is in the form of a positively acting ring.

14. A turbine blade locking device in accordance with claim 10, wherein the retaining groove axially leads to an outer area of the lobe slot.

15. A turbine blade locking device in accordance with claim 14, wherein a retaining element is fined between the blade root and the turbine disk to provide for further axial retention.

16. A turbine blade locking device in accordance with claim 15, wherein the retaining element is in the form of a positively acting ring.

* * * * *